US011688552B2

(12) United States Patent
Vitry

(10) Patent No.: US 11,688,552 B2
(45) Date of Patent: Jun. 27, 2023

(54) METHOD FOR ASSEMBLING A MAGNETIC INDUCTOR AND MAGNETIC INDUCTOR ABLE TO BE OBTAINED BY MEANS OF SUCH A METHOD

(71) Applicant: COMMISSARIAT À L'ÉNERGIE ATOMIQUE ET AUX ÉNERGIES ALTERNATIVES, Paris (FR)

(72) Inventor: Sylvain Vitry, Forcalquier (FR)

(73) Assignee: COMMISSARIAT A L'ÉNERGIE ATOMIQUE ET AUX ÉNERGIES ALTERNATIVES, Paris (FR)

( * ) Notice: Subject to any disclaimer, the term of this patent is extended or adjusted under 35 U.S.C. 154(b) by 487 days.

(21) Appl. No.: 16/765,055

(22) PCT Filed: Nov. 19, 2018

(86) PCT No.: PCT/FR2018/052906
§ 371 (c)(1),
(2) Date: May 18, 2020

(87) PCT Pub. No.: WO2019/097194
PCT Pub. Date: May 23, 2019

(65) Prior Publication Data

US 2021/0375539 A1 Dec. 2, 2021

(30) Foreign Application Priority Data

Nov. 20, 2017 (FR) ..... 1760944

(51) Int. Cl.
*H01F 41/02* (2006.01)
*H01F 27/245* (2006.01)
(Continued)

(52) U.S. Cl.
CPC ..... *H01F 41/0233* (2013.01); *F04B 17/04* (2013.01); *H01F 27/245* (2013.01); *H01F 41/066* (2016.01)

(58) Field of Classification Search
None
See application file for complete search history.

(56) References Cited

U.S. PATENT DOCUMENTS 3,307,132 A 2/1967 Ellis
3,553,622 A 1/1971 Subovici
(Continued)

FOREIGN PATENT DOCUMENTS

CN 200959264 Y * 10/2007
DE 10314265 A1 10/2004
(Continued)

OTHER PUBLICATIONS

Machine translation of CN 200959264Y. (Year: 2007).*
(Continued)

*Primary Examiner* — Xiaowei Su
(74) *Attorney, Agent, or Firm* — Pearne & Gordon LLP

(57) ABSTRACT

A method for assembling a magnetic inductor for an electromagnetic pump comprising the following steps: providing a plurality of magnetic laminations having a cross section of an involute of a circle; assembling the plurality of magnetic laminations by fitting same into an inductor core; cutting out at least one housing for an elementary coil; providing and placing an elementary coil inside each housing formed in the cutting step and thereby forming the magnetic inductor. Further, a magnetic inductor formed by implementing such a method and an electromagnetic pump including at least one magnetic inductor.

16 Claims, 6 Drawing Sheets

(51) Int. Cl.
*F04B 17/04* (2006.01)
*H01F 41/066* (2016.01)

(56) References Cited

U.S. PATENT DOCUMENTS

| | | | |
|---|---|---|---|
| 4,814,736 | A | 3/1989 | Lee et al. |
| 2010/0327785 | A1 | 12/2010 | Crewson et al. |
| 2011/0050376 | A1 | 3/2011 | Gerster et al. |

FOREIGN PATENT DOCUMENTS

| | | | |
|---|---|---|---|
| FR | 1590782 | A | 4/1970 |
| GB | 515545 | A | 12/1939 |
| GB | 1244628 | A | 9/1971 |
| GB | 2133932 | A | 8/1984 |
| JP | S60165705 | A | 8/1985 |

OTHER PUBLICATIONS

Specification and drawings for U.S. Appl. No. 16/763,871, entitled Magnetic Inductor, Electromagnetic Pump Comprising Such a Magnetic Inductor and Method for Manufacturing a Magnetic Inductor, filed May 13, 2020.
International Search Report for PCT-FR2018/052906 dated Mar. 21, 2020.
Written Opinion for PCT-FR2018/052906 dated Mar. 21, 2020.
Search Report for FR application No. FR 1760944 dated Aug. 28, 2018.
Roman, Christian et al. "Study of the Electromagnetic Phenomena in the Annular Linear Induction Pump based on 3D Finite Element Models" IN: THe 8th International Symposium On Advanced Topics In Electrical Engineering, May 23, 2013, pp. 1-6.
Cea. "CEA/DTN/SPTA/LCIT", Jan. 16, 2012, Retreived from the Internet: http://www.gedeon.prd.fr/ATELIERS/16_17_01_2012/exposes/16A/REY_Atelier_GEDEPEON_bilan.pdf (retreived on Aug. 24, 2018), XP055502105, p. 3.

* cited by examiner

Fig. 4
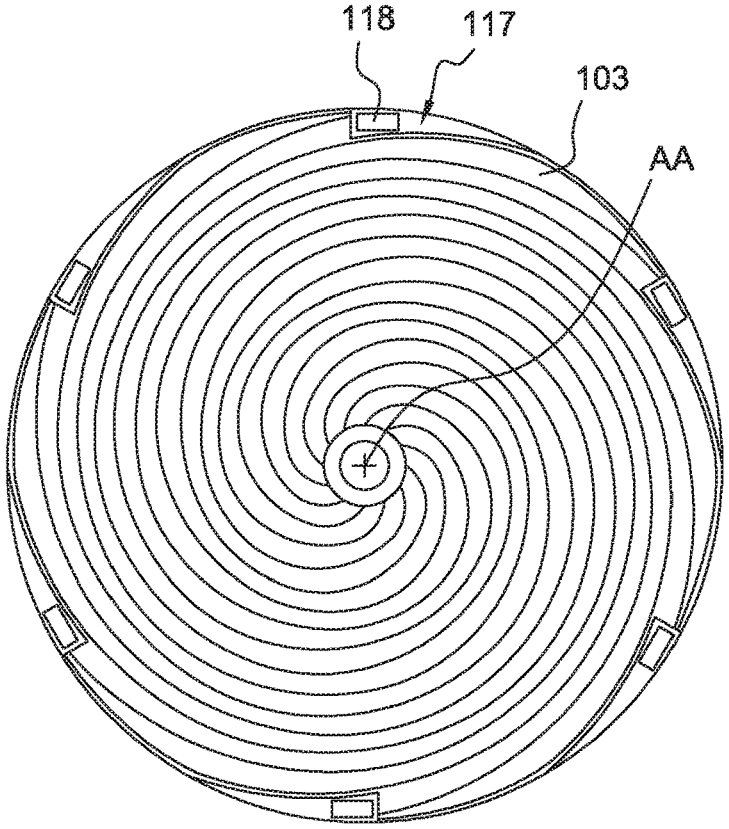
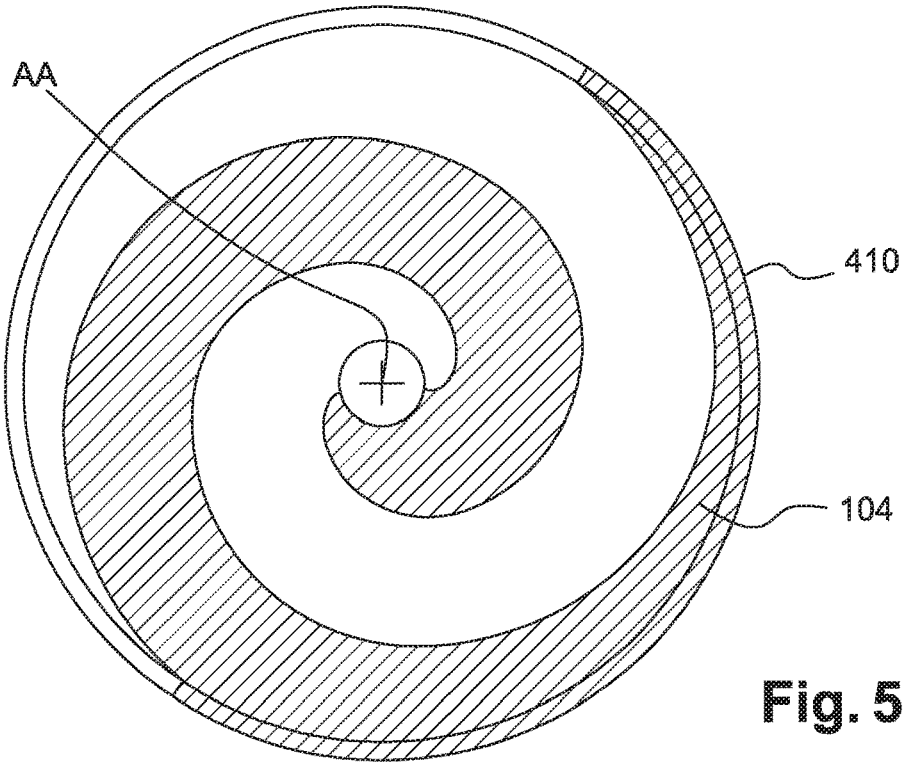
Fig. 5

METHOD FOR ASSEMBLING A MAGNETIC INDUCTOR AND MAGNETIC INDUCTOR ABLE TO BE OBTAINED BY MEANS OF SUCH A METHOD

CROSS-REFERENCE TO RELATED APPLICATIONS

This is the National Stage of PCT international application PCT/FR2018/052906, filed on Nov. 19, 2018, which claims the priority of French Patent Application No. 1760944, filed Nov. 20, 2017, both of which are incorporated herein by reference in their entirety.

TECHNICAL FIELD

The invention relates to the field of annular electromagnetic pumps and the magnetic inductors which equip them.

Thus, the object of the invention is a method for manufacturing a magnetic inductor, a magnetic inductor and an electromagnetic pump including such a magnetic inductor.

Prior Art

In order to optimise the pumping capacity of annular electromagnetic pumps, it is known to equip them with two magnetic inductors, one internal, delimiting with a protection tube an internal wall of a channel of the electromagnetic pump, the other external, delimiting, with a protection tube an external wall of the channel.

Such an electromagnetic pump 1 thus includes, as illustrated in FIG. 1 and starting from a central axis 301 of the electromagnetic pump 1:

- the internal magnetic inductor 10 including a first plurality of elementary coils 111, 121, 131,
- the internal protection tube 310,
- the channel 320,
- the external protection tube 330,
- the external magnetic inductor 20 including a second plurality of elementary coils 211, 221, 231.

For each of the internal and external magnetic inductors 10, 20, the elementary coils 111, 121, 131, 211, 221, 231 follow one another along the central axis 301 of the electromagnetic pump 1. In order to generate a magnetic field sliding along the main axis, the elementary coils 111, 121, 131, 211, 221, 231 of the internal and external magnetic inductors 10, 20 are power supplied by a polyphase current, in FIG. 1A a three-phase current.

Thus, an electromagnetic pump 1 includes two magnetic inductors 10, 20 each comprising:

- an inductor body 100, or inductor core 100, having on one of an external surface and an internal surface peripheral grooves each forming a housing for one of the elementary coils 111, 121, 131, 211, 221, 231,
- the elementary coils 111, 121, 131, 211, 221, 231.

Note that in the above and throughout the rest of this document, the terms "inductor core" and "inductor body" are used interchangeably and therefore have the same meaning. It is therefore possible, throughout this text, to substitute "inductor core" by "inductor body" without changing its meaning and teaching.

Currently, the inductor core 100, whether that of the internal magnetic inductor 10 or that of the external magnetic inductor 20, is generally manufactured by means of flat magnetic plates of variable dimensions and disposed axially.

Consequently, during the manufacture of a magnetic inductor 10, 20, said manufacture is made more complex by the need to manage the different sizes of magnetic plates. In addition, the inductor core 100 thus manufactured has a poorly optimised density. Indeed, the arrangement between the different magnetic plates, due to a generally imperfect size/shape adjustment, generates the presence of cavities. It should also be noted that the arrangement and alignment between the different magnetic plates are also made more complex due to the presence in each of the magnetic plates of orifices intended to form the housings of the elementary coils.

In order to partially overcome these problems, it is known from document US 2011/0050376 to use magnetic plates extending along a main axis and having a cross section in the shape of an involute of a circle. With such a shape, it is possible to form the inductor core using magnetic plates having an identical dimensioning while optimising the density of the inductor core.

However, such a manufacturing method has a number of disadvantages. Indeed, in order to provide the notches for housing the elementary coils, it is necessary to drill each of the magnetic plates with orifices before they are shaped into an involute of a circle. However, because of these orifices, the shaping of the involute of a circle is generally imperfect. In addition, during the assembly of the magnetic plates by interlocking, these orifices can interfere with each other and thus cause interlocking difficulties, or even be responsible for the damage to the magnetic plates. Finally, in order to meet the tolerances related to the manufacture of such magnetic inductors, it is necessary to perfectly control both the drilling of these orifices and the alignment of the different magnetic plates. Indeed, the slightest misalignment between the orifices requires a correction of the elementary coil housing that they form. However, such a correction can be detrimental for the electrical insulation.

DESCRIPTION OF THE INVENTION

The invention aims at to least partially overcoming the above disadvantages and thus has the purpose of allowing the manufacture of magnetic inductors having an optimised density with respect to magnetic inductors made from flat magnetic plates, this with a method which does not have the disadvantages of magnetic plate alignments related to the manufacturing method proposed by document US 2011/0053076.

To this end, the invention relates to a method for assembling a magnetic inductor for an electromagnetic pump comprising the following steps:

- providing a plurality of identical magnetic plates, each of the magnetic plates extending along a main axis and having a cross section in the shape of a circle involute,
- assembling the plurality of magnetic plates by interlocking in order to form an axial tubular inductor core, the circle of the involute of a circle of the magnetic plates being merged together,
- cutting at least one elementary coil footprint in a longitudinal surface of the tubular inductor core from an internal longitudinal surface and an external longitudinal surface in order to form at least one housing for an elementary coil,
- providing and placing an elementary coil in each housing formed during the cutting step in order to form the magnetic inductor.

With the manufacturing method according to the invention, the cutting of the notches being subsequent to the assembly of the magnetic plates and therefore to the alignment of the latter, the risks of misalignment and having to make a correction which would be detrimental to the electrical insulation are completely removed.

In the same way, the orifices forming said notches not yet being formed during the shaping of the magnetic plates and during their assembly to form the inductor core, these two steps are thereby facilitated and not hindered. Thus the manufacturing method according to the invention is therefore simplified with respect to that of document US 2011/0053076 and the risks of damaging the plates greatly limited. Moreover, the inductor thus formed, benefits, in the same way as an inductor described in document US 2011/0053076, from an optimised density related to the use of magnetic plates extending along a main axis and having a cross section in the shape of an involute of a circle.

"Identical magnetic plates" means, in the above and in the rest of this document, that the magnetic plates have an identical shape, within given tolerances.

The method may further comprise, between the step of providing the plurality of magnetic plates and the assembly step, a step of providing at least one element from a dielectric coating, a friction reduction coating, a dielectric interlayer sheet, a friction reduction interlayer sheet, during the assembly step, said element being disposed so as to be interposed between at least two magnetic plates.

Such elements allow:

- in the case of friction reduction elements such as the friction reduction coating and the friction reduction interlayer sheet, to facilitate the assembly of the plates together, since it is easy to slide them one into the other,
- in the case of the dielectric elements that are the dielectric coating and the dielectric interlayer sheet, to obtain good electrical insulation between the plates thus limiting any short-circuits between the plates related to the induced electromagnetic fields.

During the step of providing magnetic plates, a number N×M magnetic plates can be provided, N being an integer greater than or equal to 1 and M being an integer greater than or equal to 2, when providing the at least one element, N copy of said element can be provided, a copy of said element being interposed between two consecutive magnetic plates all the M magnetic plates.

In this way, it is possible to obtain a satisfactory effect of said element without necessarily using the same number of elements as magnetic plates.

During the step of providing magnetic plates, a number N×M+O magnetic plates can be provided, N being a natural number greater than or equal to 1 and M being a natural number greater than 2, O being a natural number strictly less than M, the assembly step including the following sub-steps:

- assembling N subsets of M magnetic plates by interlocking, the circle of the involute of a circle of the M magnetic plates of the same subset being merged together, the remaining O magnetic plates being either distributed in at least part of the N subsets, or assembled in the form of an additional subset,
- assembling the N subsets and the possible additional subset by interlocking in order to form a tubular inductor core, the circle of the involute of a circle of the magnetic plates being merged together.

The assembly of the magnetic plates is thereby facilitated.

During the assembly of the N subsets by interlocking in order to form a tubular inductor core, at least two subsets have a misalignment, the subsets can follow one another, preferably misaligned in pairs.

The method may further comprise, between the step of providing the plurality of magnetic plates and the assembly step, a step of providing a respective copy for each subset of the element from a dielectric coating, a friction reduction coating, a dielectric interlayer sheet, a friction reduction interlayer sheet, during the sub-step of assembling the N subsets by interlocking, the respective copy of the element being disposed so as to be interposed between the corresponding subset and the directly following subset.

With such an element, the insulation and/or assembly of the subsets are optimised.

The element may be at least one from a dielectric coating, a friction reduction coating and wherein each magnetic plate has at least one first and one second face, the provision of the at least one element consisting in the application of the corresponding coating on at least one of the faces of a magnetic plate.

In this way, the insulation of the magnetic plates and the assembly of the latter are optimised without requiring a step of placing an interlayer sheet.

Between the step of cutting at least one elementary coil footprint and the step of providing and placing an elementary coil, a step of applying an insulating coating on at least part of the surface area of the at least one housing formed during cutting may further be provided.

In this way, good insulation of the inductor core from the elementary coils is ensured.

The step of providing and placing an elementary coil in each housing can comprise the following sub-steps:

- providing a cable intended to form said elementary coil,
- winding the cable in each of said housings to form the corresponding elementary coil.

During the step of cutting at least one elementary coil footprint, a plurality of footprints can be cut, the method further comprising the following steps:

- cutting at least one conductor footprint in at least one of the internal longitudinal surface and the external longitudinal surface, said conductor footprint being configured to extend between two elementary coil housings,
- after the step of providing and placing an elementary coil in each of the housings and at the step of cutting the at least one conductor footprint, providing a respective conductor for each of the conductor footprints and placing said conductor in the corresponding conductor footprints by connecting the elementary coils housed in the two elementary coil footprints between which the corresponding conductor footprint extends.

The magnetic inductor manufactured can be an internal inductor.

Such a method allows forming a magnetic inductor particularly benefiting from the compactness provided by the invention.

The invention also relates to a method for manufacturing an electromagnetic pump including a step of providing a magnetic inductor by means of an assembly method according to the invention.

Such a method allows providing an electromagnetic pump, the inductor of which benefits from the advantages related to the invention.

The invention further relates to a magnetic inductor for an electromagnetic pump capable of being obtained by a method according to the invention, the magnetic inductor including:

- an axial tubular inductor core including a plurality of magnetic plates, each of the magnetic plates extending along a main axis and having a cross section in the shape of an involute of a circle, the magnetic plates being assembled by interlocking with the circle of the involute of a circle of the magnetic plates which are merged, the magnetic plates being identical with the exception of one or more possible footprint(s), said magnetic plates comprising at least one footprint of an elementary coil cut to form a housing for said elementary coil and which is arranged on a longitudinal surface of the tubular inductor core from an internal longitudinal surface and an external longitudinal surface, a respective elementary coil in the or each housing formed by cutting the footprint of the tubular inductor core.

Such an inductor has an optimised electrical insulation since during its manufacture there was no need for a correction which would have been detrimental to the electrical insulation.

Said magnetic inductor can be an internal magnetic inductor of the magnetic pump.

Such an inductor particularly benefits from the compactness provided by the method according to the invention.

The invention further relates to an electromagnetic pump including at least one first magnetic inductor according to the invention, the electromagnetic pump preferably including a second magnetic inductor according to the invention.

BRIEF DESCRIPTION OF THE DRAWINGS

The present invention will be better understood upon reading the description of exemplary embodiments, given in a purely indicative and non-limiting manner, with reference to the appended drawings wherein:

FIG. 4 is a sectional view of an inductor according to the invention showing the passages of the conductors used to connect the elementary coils, FIG. 5 illustrates a sectional view of an assembly of a first subset of magnetic plates by means of a strapping.

Identical, similar or equivalent parts of the different figures have the same reference numerals so as to facilitate the passage from one figure to another.

The different parts shown in the figures are not necessarily shown on a uniform scale, to make the figures more readable.

Detailed Description of Particular Embodiments

FIGS. 2A to 2G illustrate the main steps of manufacturing a magnetic inductor according to the invention.

In this case, the magnetic inductor 10 is an internal magnetic inductor of an electromagnetic pump 1.

Figure 1:
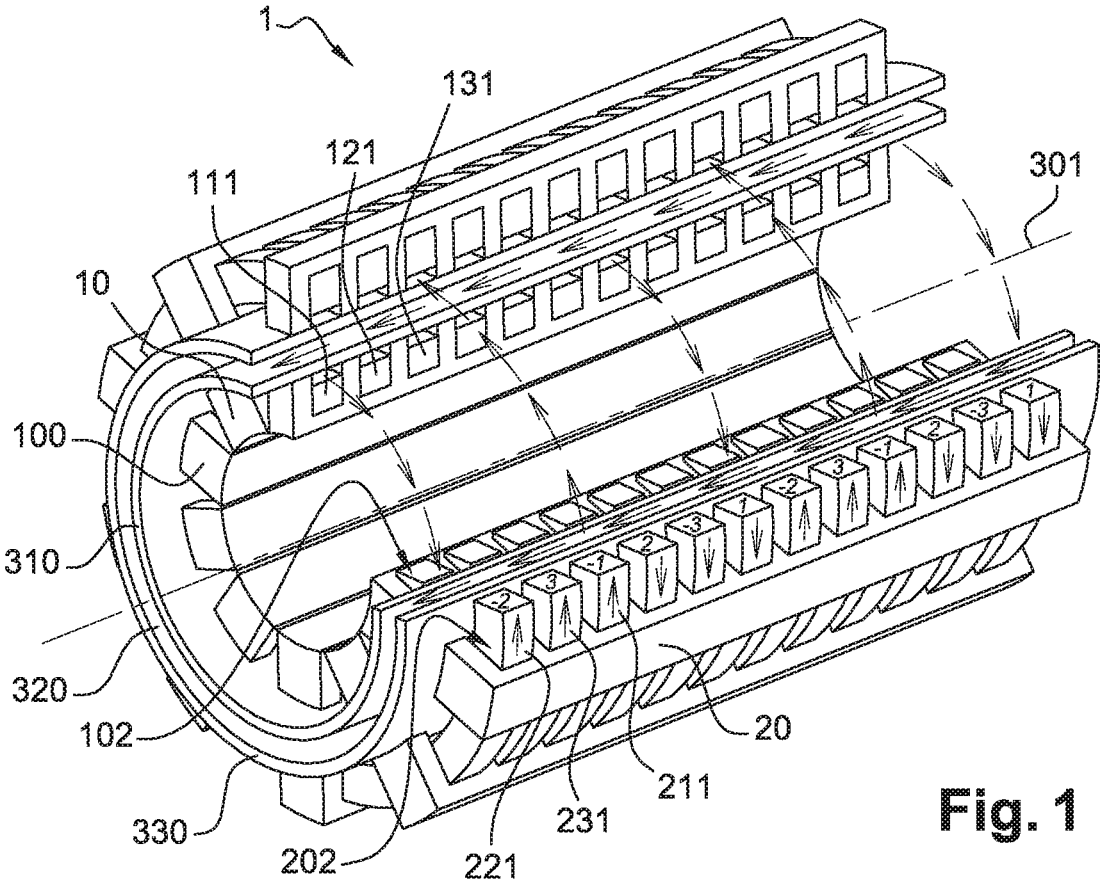
FIG. 1 is a figure illustrating the different parts of an electromagnetic pump comprising an internal magnetic inductor and an external magnetic inductor, FIGS. 2A to 2G schematically illustrate the different steps of manufacturing an internal inductor according to the invention, FIGS. 3A and 3B respectively illustrate a perspective view of the winding circuit of a magnetic inductor according to the invention and a schematic view of the pairwise coupling of elementary coils according to the invention.

Such a magnetic inductor 10 includes, in the same way as an internal inductor of the prior art as illustrated in FIG. 1:

an inductor body, or inductor core, 100 having on one of an external surface 101A and an internal surface 101B peripheral grooves forming respective housings 102 for elementary coils 111, 112, 121, 122, 131, 132, the elementary coils 111, 112, 121, 122, 131, 132, conductors, not shown in FIG. 1A, allowing to connect the elementary coils to each other and to connect them to the first, second and third phases P1, P2 P3, not shown in FIG. 1A and which will be described in connection with the FIGS. 3A and 3B.

The inductor core 100 according to the invention has the particularity of including a plurality of identical magnetic plates 103, each of the magnetic plates 103 extending along a main axis AA and having a cross section in the shape of an involute of a circle. Each of these magnetic plates 103 includes orifices, or notches, following each other along the main axis AA. Each of said orifices participates in the formation, with the corresponding orifices of the other magnetic plates 103, of a respective housing 102 for one of the elementary coils 111, 112, 121, 122, 131, 132.

According to a preferred possibility of the invention, the inductor core 10 can include at least one element 107 from a dielectric coating, a friction reduction coating, a dielectric interlayer sheet, a friction reduction interlayer sheet. The element 107 is interposed between two consecutive magnetic plates.

In the above and in the rest of this document, friction reduction coating means a coating of a material having a coefficient of friction with a magnetic plate which is less than the coefficient of friction between two magnetic plates. Such a coating can, for example, be a coating comprising a ceramic material and/or a fluoropolymer such as polytetrafluoroethylenes (PTFE) such as those sold by the company DUPONT under the name Teflon™.

In the same way, a friction reduction interlayer sheet is a sheet whose composition is adapted so that the sheet has a coefficient of friction with a magnetic plate which is less than that between two magnetic plates.

Likewise, a coating or an interlayer sheet can be qualified as dielectric in the case where this coating, or this interlayer sheet, has a relative permittivity greater than or equal to 1.

It will of course be noted that such an element 107 can have two functions, that thus forming, for example, both a dielectric coating and a friction reduction coating or also include two sub-elements, such as a dielectric coating and a friction reduction sheet.

According to a preferred possibility of the invention, the inductor core 100 includes:

N×M+O magnetic plates 103, N being a natural number greater than or equal to 1 and M being a natural number greater than or equal to 2, O being a natural number strictly less than M, N×M the magnetic plates being assembled into N subsets of M magnetic plates, the O remaining magnetic plates being either distributed in the N subsets 104, or forming an additional subset 104, a respective copy of said element 107 for each of the subsets 104, a copy of said element 107 being interposed between two successive subsets.

Of course, depending on the number of magnetic plates 103 necessary to form the inductor core 100, the number O can perfectly be zero. According to this possibility, the inductor core 100 then includes N×M magnetic plates 103 and N copies of said element 107.

In the same way, according to an advantageous possibility of the invention, M can be equal to 1, O then being zero and the number of copies of the element is then equal to the number of magnetic plates 103.

Thus, for example, such elements may be a ceramic coating applied on a part of the magnetic plates 103, for example all the ten magnetic plates.

It should be noted that, according to a similar possibility, the inductor 10 may also include in each of the housings 102 an electrical insulator, such as a sheet of mica or a coating made of electrically insulating material. Similarly, it is possible within the scope of the invention that one or more, or even all, of the housings are provided with at least one sensor, such as a magnetic field sensor or a thermometer.

Electrical insulator, should be understood here and in the rest of this document, as an interlayer material having a relative permittivity greater than or equal to 1.

Each elementary coil 111, 112, 121, 122, 131, 132 consists of a conductor 110, such as a copper cable, wound in the corresponding housing 102, said conductor 110 including an insulator 109 for electrically insulating each of the turns S of said elementary coil 111, 112, 121, 122, 131, 132 from the turns S which are directly adjacent thereto.

Figure 2A:
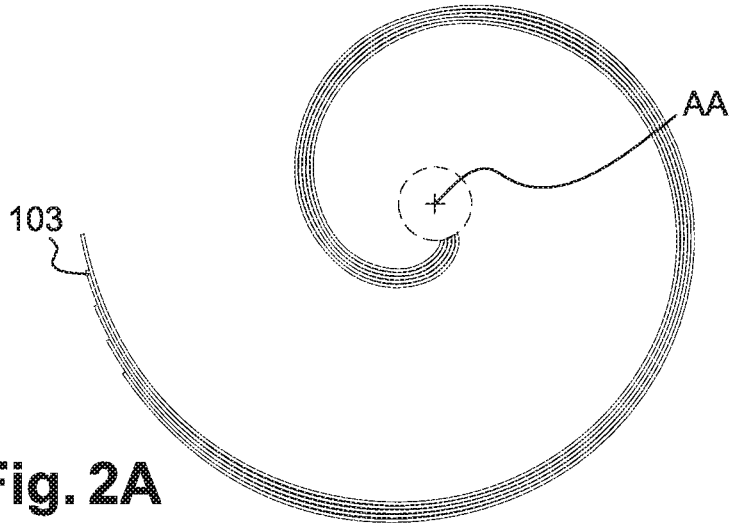
Figure 2B:
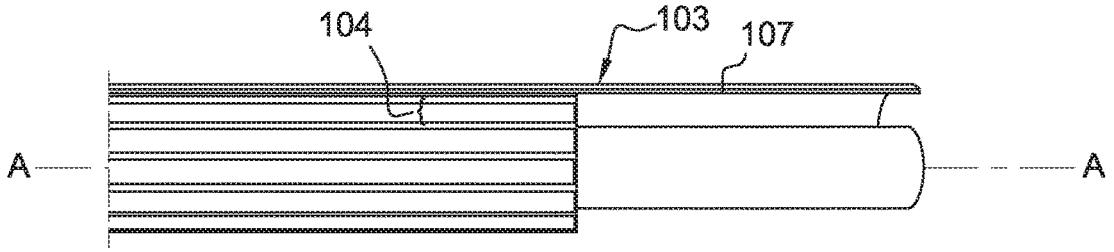
Figure 2C:
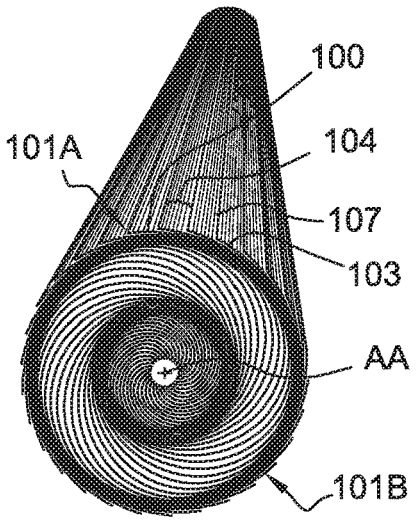
Figure 2D:
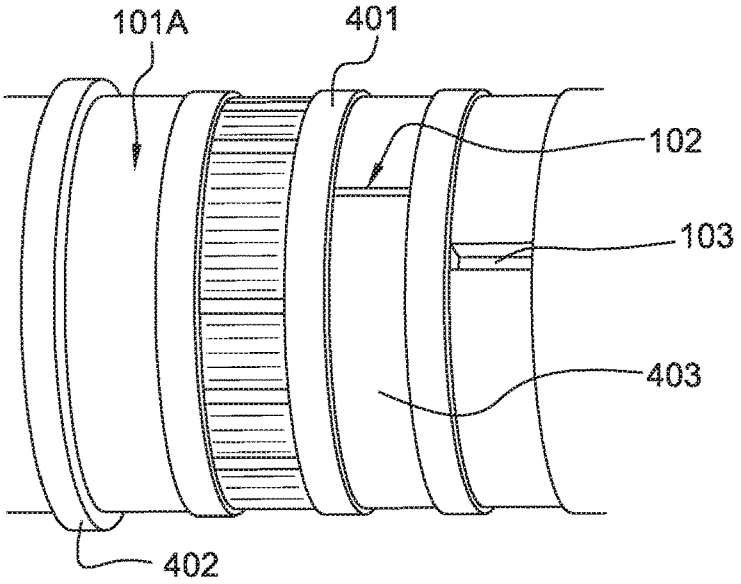
Figure 2E:
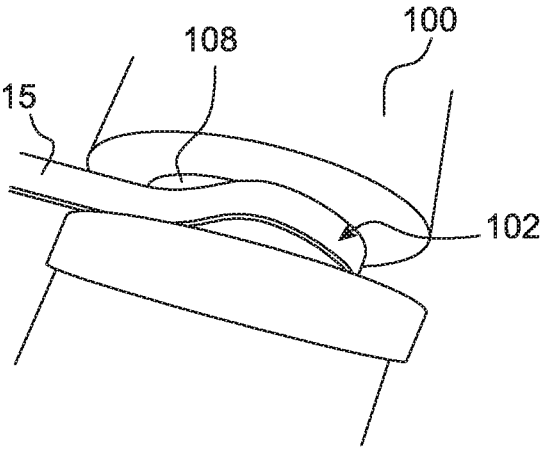
Figure 2F:
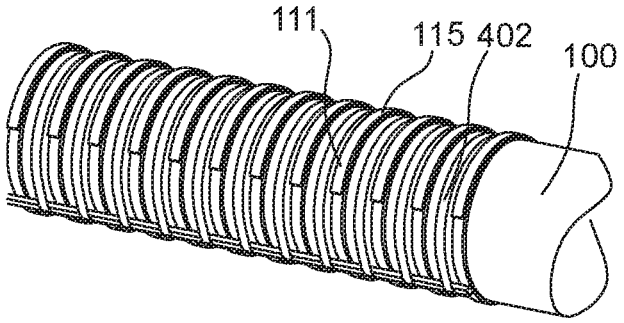
Figure 2G:
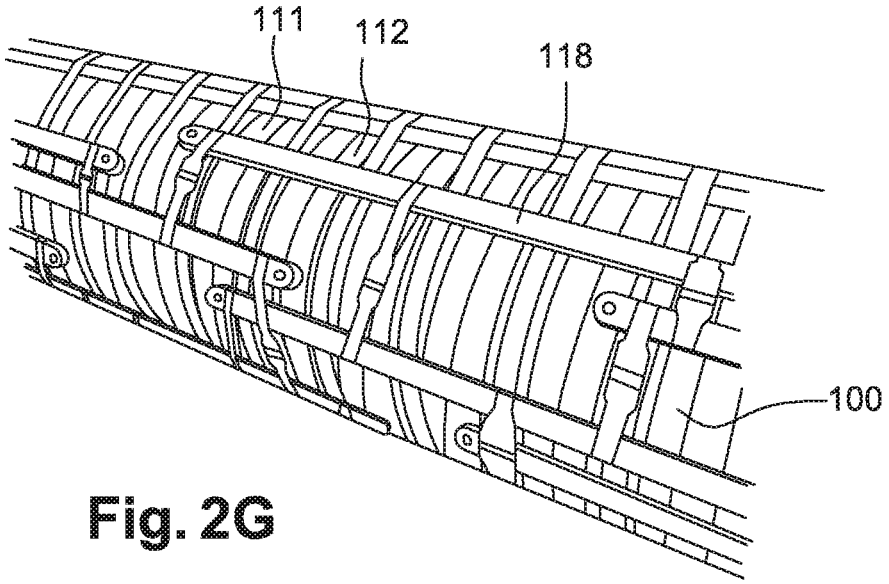

Such an inductor 10 can be manufactured by implementing an assembly method including the following steps:

- providing the plurality of identical magnetic plates 103, each of the magnetic plates 103 extending along a main axis AA and having a cross section in the shape of an involute of a circle,
- assembling the plurality of magnetic plates 103 by interlocking in order to form an axial tubular inductor core 100, the circle of the involute of a circle of the magnetic plate 103 being merged together, as illustrated in FIGS. 2A to 2C,
- cutting, in the external longitudinal surface of the inductor core 100, a footprint of elementary coil 111, 112, 121, 122, 131, 132 each corresponding to a housing 102 in order to house a corresponding elementary coil 111, 112, 121, 122, 131, 132, as illustrated in FIG. 2D,
- winding an elementary coil 111, 112, 121, 122, 131, 132 in each of the housings formed during the cutting step, said winding allowing to provide and place said elementary coils 111, 112, 121, 122, 131, 132, and therefore to form the magnetic inductor 10, as illustrated in FIGS. 2E and 2F.

The step of providing the plurality of magnetic plates 103 may include the following sub-steps:

- providing a plurality of magnetic plates which are identical rectangular and not illustrated, and
- shaping each of the magnetic plates into identical involute of a circle so as to provide the magnetic plates 103 according to the invention, illustrated in FIG. 2A.

In the case where a number N×M+O magnetic plates, N being an integer greater than or equal to 1, M being an integer greater than or equal to 2 and O being a natural number strictly less than M, is provided in the step of providing the plurality of magnetic plates 101, the step of assembling the magnetic plates 103 may include the following sub-steps:

- assembling N subsets 104 of M magnetic plates 103 by interlocking, the circle of the involute of a circle of the M magnetic plates 103 of the same subset being merged together, the remaining O magnetic plates 103 being either distributed in at least part of the N subsets, or assembled to form an additional subset 104 as illustrated in FIG. 2A,
- assembling the N subsets and the possible additional subset 104 by interlocking in order to form an axial tubular inductor core 100, the circle of the involute of a circle of the magnetic plate 103 being merged together, as illustrated in the FIG. 2B.

According to this same possibility and according to the possibility where N elements 107 are provided each selected from a dielectric coating, a friction reduction coating, a dielectric interlayer sheet, a friction reduction interlayer sheet, the step of assembling the magnetic plates 103 may further include before the step of assembling the N subsets 104 and the possible additional subset 104 by interlocking:

- providing a respective copy of said element 107 for each of the subsets 104, a copy of said element 107 being interposed between the corresponding subset 104 and the directly following subset 104, as illustrated in FIG. 2B.

Thus, according to this possibility, a copy of the element 107 is disposed between the first magnetic plate 103 of a first subset and the last magnetic plate 103 of the directly adjacent subset. Such an arrangement can be obtained, for example, by applying a ceramic coating on one of the surfaces of each of the subsets 104, said ceramic coating then acting both as a dielectric coating and as a friction reduction coating.

When assembling the N subsets 104 and the possible additional subset 104, at least one of the subsets may have a misalignment with respect to at least one other subset. In this way, it is possible to limit the appearance of current turns at the ends of the inductor core 100. It can be noted that according to this possibility, the subsets 104 follow one another preferably misaligned in pairs.

It can be noted that according to another possibility of the invention, a copy of the element 107 can be provided between each of the magnetic plates 103. According to this possibility, the assembly step then includes a prior step of providing the set of copies of the element 107.

According to one possibility of the invention, once the inductor core 100 is assembled, the inductor assembly method can comprise the following steps:

- providing a pin and an insulating sheath for the pin, not illustrated,
- drilling a radial orifice, not illustrated, shaped to receive the pin and the insulating sheath thereof,
- installing the pin and its electrically insulating sheath in the radial orifice.

This pin, preferably having a length substantially equal to the diameter of the inductor core, allows ensuring the cohesion of the magnetic plates and limiting the risks of misalignment when handling the inductor core 100.

The cutting step can include the following sub-steps:

- placing a protection tube 401 around the annular tubular inductor core 100,
- machining the inductor core 100/protection tube 401 assembly in order to form in the inductor core 100 the housings 102 for housing the elementary coils 111, 112, 121, 122, 131, 132.

Once the housings 102 are formed, a step of providing and disposing an electrical insulator 108, such as a sheet of mica, in each of the housings 102 can be provided prior to the step of winding an elementary coil 111, 112, 121, 122, 131, 132 in each housing 102. During this step, a step of placing constraint flanges 402 in order to perfectly maintain the assembly of the magnetic plates 103 and thus maintain the optimised density may also be provided.

The winding step may include, for each of the notches 102, the following steps:

- providing a conductor, such as a copper cable, not visible in FIG. 2E, said conductor being surrounded by an insulator 115
- applying the insulator 115 around the conductor, said insulator 115 being adapted to electrically insulate each of the turns S of said elementary coil 111 from the turns S which are directly adjacent thereto, winding the conductor in the corresponding housing 102 as illustrated in FIG. 2E.

It should be noted that in the context of the example of magnetic inductor 10 illustrated in FIGS. 2A to 2G, each of the elementary coils 111, 112, 121, 122, 131, 132 is made of 10 turns S distributed in two columns of 5 turns S. Thus, as shown in FIG. 2E, the conductor is shaped for its part intended to be positioned at the bottom of the housing 102 with an S-shape, to enable the passage from one column to the other. For this purpose, a compensating wedge can also be provided in the bottom of the notch in order to compensate for the S-shape and allow good centring of the turns S of the elementary coils 111, 112, 121, 122, 131, 132 with respect to the main axis AA.

Once the elementary coils 111, 112, 121, 122, 131, 132 are placed and in the case where the constraint flanges 402 have been provided to maintain the assembly of the magnetic plates 103, a step of removing the constraint flanges 402 may be provided.

In order to connect the elementary coils 111, 112, 121, 122, 131, 132 to each other, a step of providing and placing conductors 118 to connect the elementary coils 111, 112, 121, 122, 131, 132 to each other can be provided. This placement of conductors 118 can be carried out in accordance with the circuit of winding a magnetic inductor 10 illustrated in FIGS. 3A and 3B, adapted for a three-phase power supply therefore including three phases P1, P2, P3.

According to this winding circuit, for each of the phases P1, P2, P3 of the polyphase current, the magnetic inductor 10 includes N pairs $\mathbf{110}_{1,2,\ldots,N-1,N}$, $\mathbf{120}_{1,2,\ldots,N-1,N}$, $\mathbf{130}_{1,2,\ldots,N-1,N}$ of elementary coils $\mathbf{111}_{1,2,\ldots,N-1,N}$, $\mathbf{112}_{1,2,\ldots,N-1,N}$, $\mathbf{121}_{1,2,\ldots,N-1,N}$, $\mathbf{122}_{1,2,\ldots,N-1,N}$, $\mathbf{131}_{1,2,\ldots,N-1,N}$, $\mathbf{132}_{1,2,\ldots,N-1,N}$, of the same winding direction following one another from the first pair $\mathbf{110}_1$, $\mathbf{120}_1$, $\mathbf{130}_1$ to the $N^{th}$ pair $\mathbf{110}_N$, $\mathbf{120}_N$, $\mathbf{130}_N$ along the magnetic body 100, N being an integer greater than or equal to 2. Each of the pairs $\mathbf{110}_{1,2,\ldots,N-1,N}$, $\mathbf{120}_{1,2,\ldots,N-1,N}$, $\mathbf{130}_{1,2,\ldots,N-1,N}$ comprises a first and a second elementary coil $\mathbf{111}_{1,2,\ldots,N-1,N}$, $\mathbf{112}_{1,2,\ldots,N-1,N}$, $\mathbf{121}_{1,2,\ldots,N-1,N}$, $\mathbf{122}_{1,2,\ldots,N-1,N}$, $\mathbf{131}_{1,2,\ldots,N-1,N}$, $\mathbf{132}_{1,2,\ldots,N-1,N}$ which follow one another along the magnetic inductor core 101. Each elementary coil, $\mathbf{111}_{1,2,\ldots,N-1,N}$, $\mathbf{112}_{1,2,\ldots,N-1,N}$, $\mathbf{121}_{1,2,\ldots,N-1,N}$, $\mathbf{122}_{1,2,\ldots,N-1,N}$, $\mathbf{131}_{1,2,\ldots,N-1,N}$, $\mathbf{132}_{1,2,\ldots,N-1,N}$ includes two ends I, O, namely an input type end I and an output type end O.

Of course, in accordance with the operating principle of a coil, the differentiation between the input end I and the output end O is purely artificial. Indeed, the substitution of one by the other is equivalent to a simple reversal of the winding direction of said coil. Thus, the connections which are described above are valid regardless of the choice between the input I and the output O, to the extent that said convention is identical to all the elementary coils $\mathbf{111}_{1,2,\ldots,N-1,N}$, $\mathbf{112}_{1,2,\ldots,N-1,N}$, $\mathbf{121}_{1,2,\ldots,N-1,N}$, $\mathbf{122}_{1,2,\ldots,N-1,N}$, $\mathbf{131}_{1,2,\ldots,N-1,N}$, $\mathbf{132}_{1,2,\ldots,N-1,N}$ of the magnetic inductor 100.

The pairs $\mathbf{110}_{1,2,\ldots,N-1,N}$, $\mathbf{120}_{1,2,\ldots,N-1,N}$, $\mathbf{130}_{1,2,\ldots,N-1,N}$ of elementary coils $\mathbf{111}_{1,2,\ldots,N-1,N}$, $\mathbf{112}_{1,2,\ldots,N-1,N}$, $\mathbf{121}_{1,2,\ldots,N-1,N}$, $\mathbf{131}_{1,2,\ldots,N-1,N}$, $\mathbf{132}_{1,2,\ldots,N-1,N}$ are distributed along the magnetic inductor core 100 so as to provide a phase alternation P1, P2, P3 and provide a magnetic field sliding along the magnetic inductor core 100.

The connection between the elementary coils $\mathbf{111}_{1,2,\ldots,N-1,N}$, $\mathbf{112}_{1,2,\ldots,N-1,N}$ $\mathbf{121}_{1,2,\ldots,N-1,N}$, $\mathbf{122}_{1,2,\ldots,N-1,N}$, $\mathbf{131}_{1,2,\ldots,N-1,N}$, $\mathbf{132}_{1,2,\ldots,N-1,N}$ associated with the same phase of the first, the second and the third phase P1, P2, P3 is described below.

Thus, for a given phase P1, P2, P3, the first and the second elementary coil $\mathbf{111}_1$, $\mathbf{112}_1$, $\mathbf{121}_1$, $\mathbf{122}_1$, $\mathbf{131}_1$, $\mathbf{132}_1$ of the first pair $\mathbf{110}_1$, $\mathbf{120}_1$, $\mathbf{130}_1$ are respectively connected to one of the current input and the current output of said phase P1, P2, P3 and to the other of the current input and current output of said phase P1, P2, P3. Thus, as can be seen in FIG. 3B, for the first and the third phase P1, P3, the first elementary coil $\mathbf{111}_1$, $\mathbf{131}_1$ has its input I connected to the current input of said phase P1, P3 while the second elementary coil $\mathbf{112}_1$, $\mathbf{132}_1$ has its output O connected to the current output of said phase P1, P3. For the second phase P2, the first elementary coil $\mathbf{121}_1$ has its input I connected to the current output of said phase P2 while the second elementary coil $\mathbf{122}_1$ has its output O connected to the current input of said phase P2.

For this same given phase P1, P2, P3, and for each of the first to the $N-1^{st}$ pair $\mathbf{110}_{1,2,\ldots,N-1}$, $\mathbf{120}_{1,2,\ldots,N-1}$, $\mathbf{130}_{1,2,\ldots,N-1}$ associated with said phase P1, P2, P3, the first elementary coil $\mathbf{111}_{1,2,\ldots,N-1}$, $\mathbf{121}_{1,2,\ldots,N-1}$, $\mathbf{131}_{1,2,\ldots,N-1}$ has one of the ends I, O thereof connected to the end of the same type of the first elementary coil $\mathbf{111}_{1,2,\ldots,N-1}$, which directly follows it along the magnetic inductor core 101. Similarly, for each of the second to $N^{th}$ pair $\mathbf{110}_{2,\ldots,N-1,N}$, $\mathbf{120}_{2,\ldots,N-1,N}$, $\mathbf{130}_{2,\ldots,N-1,N}$ associated with said phase P1, P2, P3, the second elementary coil $\mathbf{112}_{2,\ldots,N-1,N}$, $\mathbf{122}_{2,\ldots,N-1,N}$, $\mathbf{132}_{2,\ldots,N-1,N}$ has one of the ends I, O thereof connected to the end of the same type of the second elementary coil $\mathbf{112}_{2,\ldots,N-1,N}$, $\mathbf{122}_{2,\ldots,N-1,N}$, $\mathbf{132}_{2,\ldots,N-1,N}$ which directly precedes it.

Figure 3A:
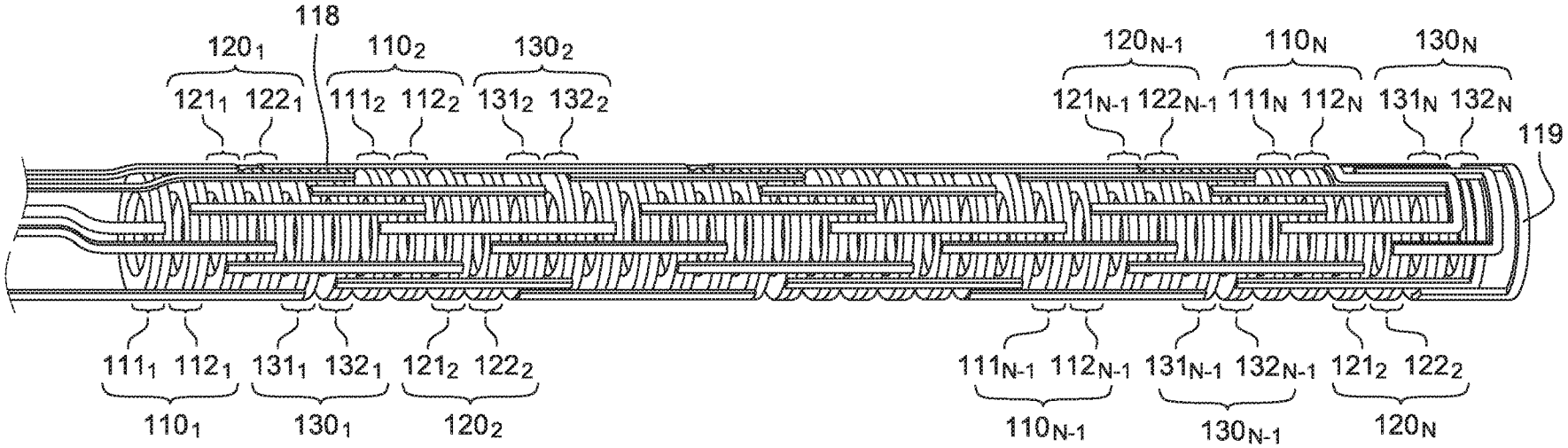
Figure 3B:
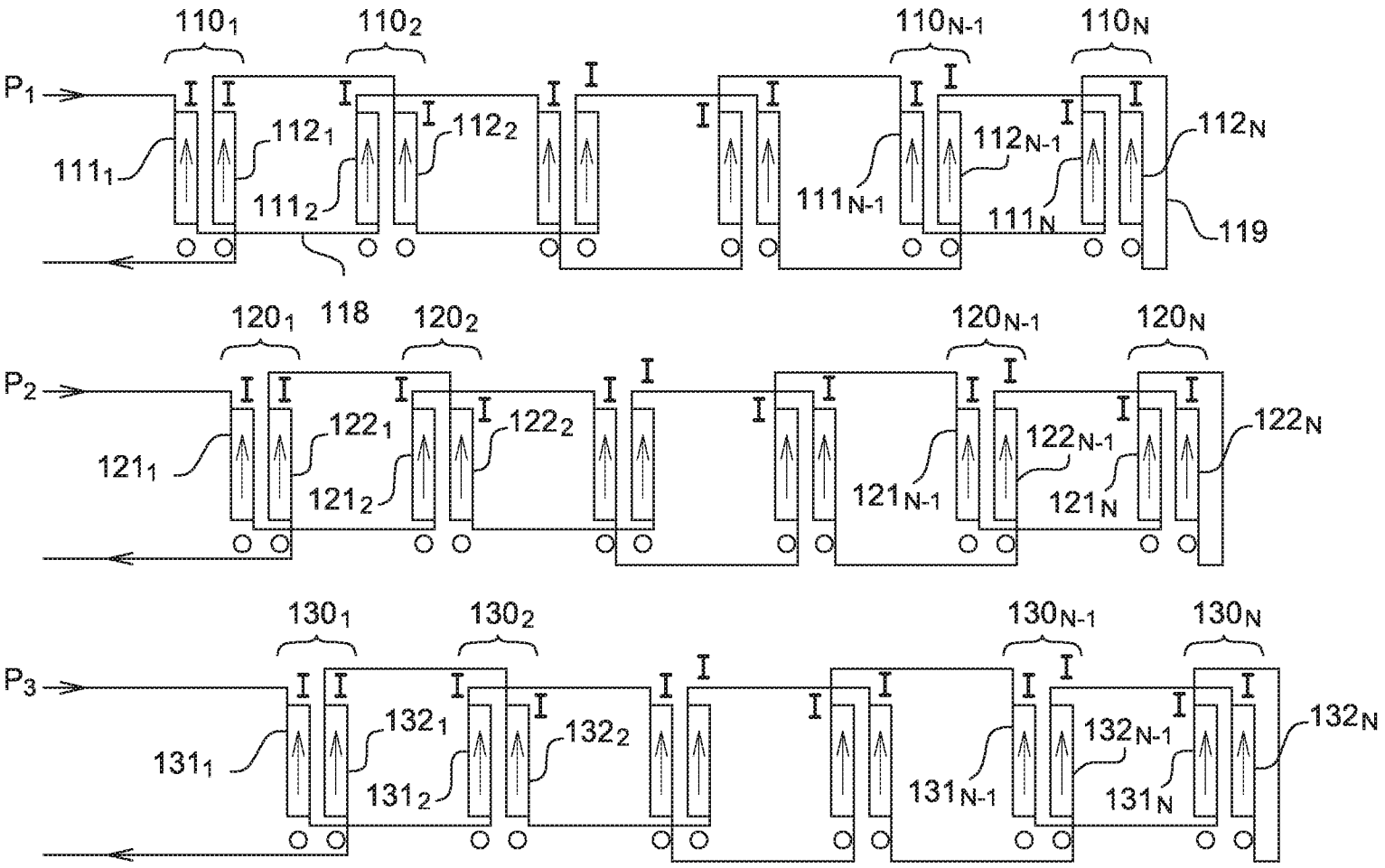

Thus, as can be seen in FIG. 3B, for all the phases P1, P2, P3, the first elementary coil 111, $\mathbf{121}_1$, $\mathbf{131}_1$ of the first pair $\mathbf{110}_1$, $\mathbf{120}_1$, $\mathbf{130}_1$ has its output O connected to the output O of the first elementary coil $\mathbf{111}_2$, $\mathbf{121}_2$, $\mathbf{131}_2$ of the second pair $\mathbf{110}_2$, $\mathbf{120}_2$, $\mathbf{130}_2$. This same first elementary coil $\mathbf{111}_2$, $\mathbf{121}_2$, $\mathbf{131}_2$ of the second pair $\mathbf{111}_2$, $\mathbf{121}_2$, $\mathbf{131}_2$ has in turn its input I connected to the input I of the first elementary coil of the third pair, which is not referenced. For these same phases P1, P2, P3, the second elementary coil $\mathbf{112}_N$, $\mathbf{122}_N$, $\mathbf{132}_N$ of the last pair $\mathbf{110}_N$, $\mathbf{120}_N$, $\mathbf{130}_N$ has its input I connected to the input I of the second elementary coil $\mathbf{112}_{N-1}$, $\mathbf{122}_{N-1}$, $\mathbf{132}_{N-1}$ of the penultimate pair $\mathbf{110}_{N-1}$, $\mathbf{120}_{N-1}$, $\mathbf{130}_{N-1}$. This same second elementary coil $\mathbf{112}_{N-1}$, $\mathbf{122}_{N-1}$, $\mathbf{132}_{N-1}$ of said phase P1, P2, P3 has its output O connected to the output O of the second coil, which is not referenced, of the pair N−2, which is not referenced.

For each of the first to the third phases P1, P2, P3, the first and second elementary coils $\mathbf{111}_N$, $\mathbf{112}_N$, $\mathbf{121}_N$, $\mathbf{122}_N$, $\mathbf{131}_N$, $\mathbf{132}_N$ of the $N^{th}$ pair $\mathbf{110}_N$, $\mathbf{120}_N$, $\mathbf{130}_N$ are connected in series. Thus the first elementary coil $\mathbf{111}_N$, $\mathbf{121}_N$, $\mathbf{131}_N$ of the last pair $\mathbf{110}_N$, $\mathbf{120}_N$, $\mathbf{130}_N$ has its input I connected to the output O of the second elementary coil $\mathbf{112}_N$, $\mathbf{122}_N$, $\mathbf{132}_N$ of this same last pair $\mathbf{110}_N$, $\mathbf{120}_N$, $\mathbf{130}_N$.

It will be noted that the connections between the elementary coils are provided, as illustrated in FIGS. 3A and 3B, by means of the straight conductors 118, as regards the elementary coils $\mathbf{111}_{1,2,\ldots,N-1}$, $\mathbf{112}_{1,2,\ldots,N-1}$, $\mathbf{121}_{1,2,\ldots,N-1}$, $\mathbf{122}_{1,2,\ldots,N-1}$, $\mathbf{131}_{1,2,\ldots,N-1}$, $\mathbf{132}_{1,2,\ldots,N-1}$ from the first to the N−1 pair $\mathbf{110}_{1,2,\ldots,N-1}$, $\mathbf{120}_{1,2,\ldots,N-1}$, $\mathbf{130}_{1,2,\ldots,N-1}$,and the connection between the elementary coils $\mathbf{111}_{N-1}$, $\mathbf{112}_{N-1}$, $\mathbf{121}_{N-1}$, $\mathbf{122}_{N-1}$, $\mathbf{131}_{N-1}$, $\mathbf{132}_{N-1}$ of the N−1 pair $\mathbf{110}_{N-1}$, $\mathbf{120}_{N-1}$, $\mathbf{130}_{N-1}$ and the elementary coils $\mathbf{111}_N$, $\mathbf{112}_N$, $\mathbf{121}_N$, $\mathbf{122}_N$, $\mathbf{131}_N$, $\mathbf{132}_N$ of the last pair $\mathbf{110}_N$, $\mathbf{120}_N$, $\mathbf{130}_N$, and U or W-shaped end conductors 119 for connection between the elementary coils of the last pair $\mathbf{110}_N$, $\mathbf{120}_N$, $\mathbf{130}_N$.

In the context of such a step of providing and placing the conductor, the assembly method may include, as illustrated in FIG. 4, a step of cutting part of the magnetic plates 103 in order to form spaces 117 to house the conductors. Such cuts can be made by cutting a longitudinal portion of the outer end, that is to say the end distant from the main axis AA, of one or more magnetic plates 103. In this way, it is possible to house a conductor 118 in the space freed by such a cut. This step of cutting a part of the magnetic plates 103 can be implemented, for example, during the step of cutting the housings 102 for the elementary coils 111, 112, 121, 122, 131, 132.

According to such a possibility of placing the conductors 118 by means of cutting the longitudinal portions of the outer end of some of the magnetic plates 103, for each of the conductors 118, at least one of said conductor 118 and the corresponding space 117 freed by the cutting of the longitudinal portions of the outer end of some of the magnetic plates 103, includes an insulator in order to insulate said conductor from the inductor core 100.

The inductor 10 thus formed, whether it is an internal inductor 10 or an external inductor 20, can then be provided as part of a method for manufacturing an electromagnetic pump 1.

Thus, the method for manufacturing an electromagnetic pump including such a magnetic inductor comprises the following steps:

providing an internal magnetic inductor 10 and an external magnetic inductor 20, at least one of the internal magnetic inductor 10 and the external magnetic inductor 20, preferably both, is obtained from a method for assembling the magnetic inductor 10 according to the invention, providing an internal protection tube 310 and an external protection tube 330, inserting the internal magnetic inductor 100 into the internal protection tube 310, and inserting the external protection tube 330 into the central opening of the external magnetic inductor 200, assembling the internal protection tube 310/internal magnetic inductor 100 assembly with the external protection tube 330/external magnetic inductor 200 assembly so as to form in the space delimited between the internal protection tube and the external protection tube of the channel 320.

It can be noted that, alternatively, and according to a possibility illustrated in FIG. 5, the assembly step may consist in assembling first and second halves of magnetic plate by means of a respective assembly tube 410 acting as a gauge and separately from each other. One of the two subsets 104 thus formed is then extracted from its assembly tube 410 and is assembled to the other subset 104 by an introduction into the assembly tube 410 of said other subset 104. In order to facilitate the assembly, this extraction and this introduction can be concomitant by aligning the two assembly tubes 410. It can be noted that the assembly tube of said other subset can also act as a protection tube 401.

What is claimed is:

1. A method for assembling a magnetic inductor for an electromagnetic pump comprising the following steps:

providing a plurality of identical magnetic plates, each of the magnetic plates extending along a main axis and having a cross section in the shape of an involute of a circle, assembling the plurality of magnetic plates by interlocking the magnetic plates together in order to form a tubular axial inductor core, the circle of the involute of a circle of the magnetic plates being merged together, cutting at least one elementary coil footprint in a longitudinal surface of the tubular inductor core selected from an internal longitudinal surface and an external longitudinal surface in order to form at least one housing for an elementary coil, providing and placing an elementary coil in each housing formed during the cutting step in order to form the magnetic inductor;

wherein between the step of cutting at least one elementary coil footprint and the step of providing and placing an elementary coil, a step of applying an insulating coating on at least part of the surface of the at least one housing formed during cutting, is further provided.

2. The assembly method according to claim 1 further comprising, between the step of providing the plurality of magnetic plates and the assembly step, a step of providing at least one element from a dielectric coating, a friction reduction coating, a dielectric interlayer sheet, a friction reduction interlayer sheet, wherein during the assembly step said element is disposed so as to be interposed between at least two magnetic plates.

3. The assembly method according to claim 2, wherein during the step of providing magnetic plates, a number magnetic plates is provided, N being an integer greater than or equal to 1 and M being an integer greater than or equal to 2, wherein when providing the at least one element, N copy of said element is provided, one of said N copy of said element being interposed between two consecutive magnetic plates all the M magnetic plates.

4. The assembly method according to claim 1, wherein during the step of providing magnetic plates, a number of magnetic plates is provided, N being a natural number greater than or equal to 1 and M being a natural number greater than 2, O being a natural number strictly less than M, wherein the assembly step includes the following sub-steps:

assembling N subsets of M magnetic plates by interlocking, the circle of the involute of a circle of the M magnetic plates of the same subset being merged together, the remaining O magnetic plates of the M magnetic plates being either distributed in at least part of the N subsets, or assembled in the form of an additional subset of O magnetic plates, assembling the N subsets and the possible additional subset by interlocking in order to form a tubular inductor core, the circle of the involute of a circle of the magnetic plates being merged together.

5. The assembly method according to claim 4, wherein, during the assembly of the N subsets by interlocking in order to form a tubular inductor core, at least two subsets have a misalignment.

6. The assembly method according to claim 5, wherein the subsets following one another are misaligned in pairs.

7. The assembly method according to claim 4 further comprising, between the step of providing the plurality of magnetic plates and the assembly step, a step of providing a respective copy for each subset of at least one element from a dielectric coating, a friction reduction coating, a dielectric interlayer sheet, a friction reduction interlayer sheet, wherein during the sub-step of assembling the N subsets by interlocking, the respective copy of the element is disposed so as to be interposed between the corresponding subset and the directly following subset.

8. The method according to claim 2, wherein the element is at least one from a dielectric coating, a friction reduction coating and wherein each magnetic plate has at least one first and one second face, providing at least one element consisting in applying the corresponding coating on at least one of the faces of a magnetic plate.

9. The method according to claim 2, wherein the step of providing and placing an elementary coil in each housing comprises the following sub-steps:

providing a cable intended to form said elementary coil, winding the cable in each of said housings to form the corresponding elementary coil.

10. The method according to claim 1, wherein during the step of cutting at least one elementary coil footprint a plurality of footprints are cut, the method further comprising the following steps:

cutting at least one conductor footprint in at least one of the internal longitudinal surface and the external longitudinal surface, said conductor footprint being configured to extend between two elementary coil housings, after the step of providing and placing an elementary coil in each of the housings and at the step of cutting the at least one conductor footprint, providing a respective conductor for each of the conductor footprints and placing said conductor in the corresponding conductor footprints by connecting the elementary coils housed in the two elementary coil footprints between which the corresponding conductor footprint extends.

11. The method according to claim 1, wherein the magnetic inductor manufactured is an internal inductor.

12. A method for manufacturing an electromagnetic pump, including a step of providing a magnetic inductor by means of an assembly method according to claim 1.

13. An electromagnetic pump including at least one first magnetic inductor according to claim 12.

14. The electromagnetic pump according to claim 13, further including a second magnetic inductor.

15. A magnetic inductor for an electromagnetic pump being obtained by a method according to claim 1, the magnetic inductor including:

an axial tubular inductor core including a plurality of magnetic plates each of the magnetic plates extending along a main axis and having a cross section in the shape of a involute of a circle, the magnetic plates being assembled by interlocking with the circle of the involute of the circle of the magnetic plates merged together, the magnetic plates being identical with the exception of one or more possible footprint(s), said magnetic plates comprising at least one footprint of an elementary coil cut to form a housing for said elementary coil and which is arranged on a longitudinal surface of the tubular inductor core from an internal longitudinal surface and an external longitudinal surface, a respective elementary coil in the or each housing formed by cutting the footprint of the tubular inductor core.

16. The magnetic inductor according to claim 15, wherein said magnetic inductor is an internal magnetic inductor of the magnetic pump.

* * * * *